US008752836B2

(12) United States Patent
Chen

(10) Patent No.: US 8,752,836 B2
(45) Date of Patent: Jun. 17, 2014

(54) PAPER DELIVERY DEVICE

(71) Applicant: Hon Hai Precision Industry Co., Ltd., New Taipei (TW)

(72) Inventor: Yi-Kun Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/862,733

(22) Filed: Apr. 15, 2013

(65) Prior Publication Data

US 2013/0341860 A1 Dec. 26, 2013

(30) Foreign Application Priority Data

Jun. 26, 2012 (TW) ..... 101122895 A

(51) Int. Cl.
*B65H 5/02* (2006.01)

(52) U.S. Cl.
USPC ..... 271/273; 271/81

(58) Field of Classification Search
USPC ..... 271/272–274, 314, 81; 399/388, 389; 400/624, 625
See application file for complete search history.

(56) References Cited

U.S. PATENT DOCUMENTS

2011/0193286 A1* 8/2011 Compera et al. ..... 271/228

* cited by examiner

*Primary Examiner* — Michael McCullough
(74) *Attorney, Agent, or Firm* — Novak Druce Connolly Bove + Quigg LLP

(57) ABSTRACT

A paper delivery device includes a mounting shaft, a paper guide assembly attached to the mounting shaft, a first wheel, a second wheel, and a driving module configured to drive the first wheel and the second wheel to rotate in a first direction or a second direction that is reverse to the first direction. The paper guide assembly includes a first guide module attached to the mounting shaft and a second guide module attached to the mounting shaft. The first wheel abuts the first guide module. The second wheel abuts the second guide module. The first guide module and the second guide module is movable towards each other when the first wheel and the second wheel rotate in the first direction, or movable away from each other when the first wheel and the second wheel rotate in the second direction.

17 Claims, 5 Drawing Sheets

PAPER DELIVERY DEVICE

BACKGROUND

1. Technical Field

The present disclosure relates to a paper delivery device.

2. Description of Related Art

Paper delivery devices are widely used in electronic devices, such as printers, scanners, etc. A typical paper delivery device includes a paper delivery wheel, a first paper guide module, and a second paper guide module. The first paper guide module and the second paper guide module both abut the paper delivery wheel. When the paper delivery wheel delivers a paper, the first paper guide module and the second paper guide module abut on the paper. However, a distance between the first paper guide module and the second paper guide module is not adjustable. The paper delivery device is not suitable to deliver papers of different sizes.

Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
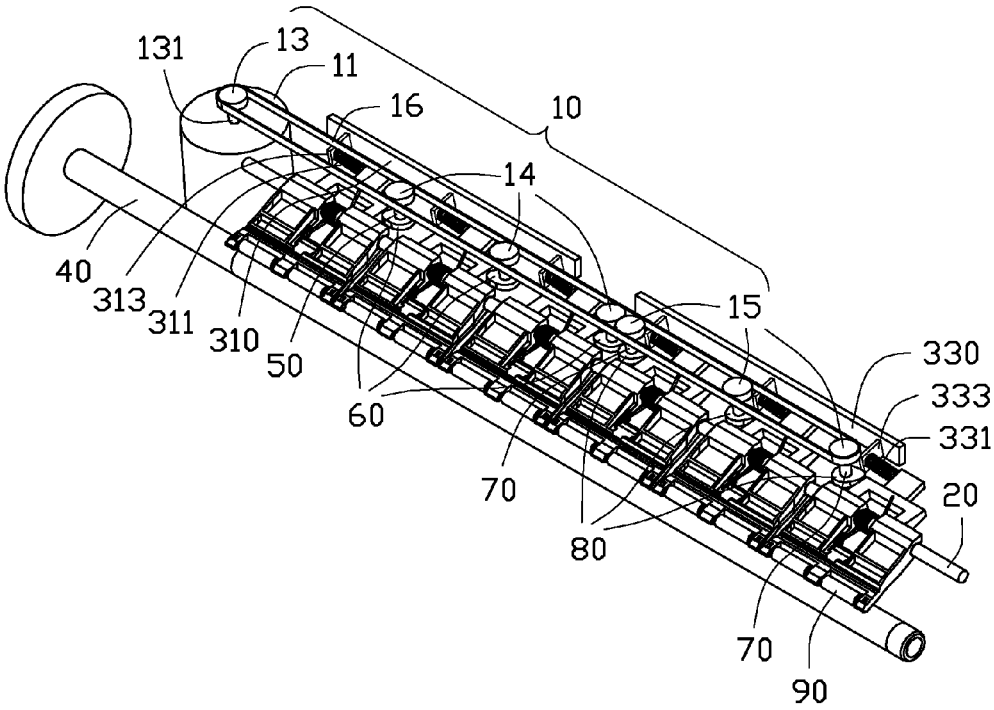
FIG. 1 is a partial view of a paper delivery device in accordance with an embodiment, showing a paper guide assembly in a first position.
Figure 2:
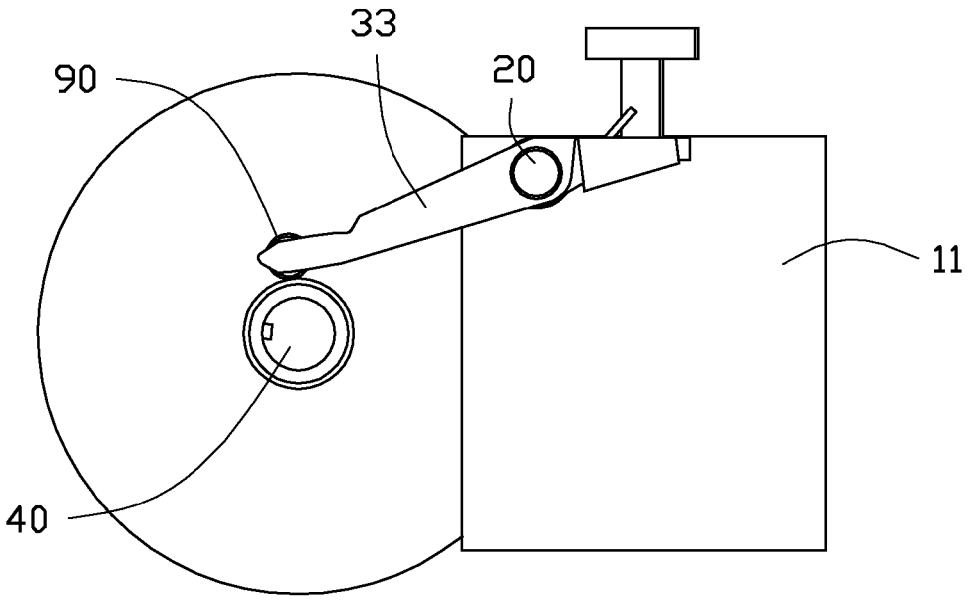
FIG. 2 is side view of FIG. 1.

FIGS. 1 and 2 show a paper deliver device of the present embodiment. The paper delivery device includes a driving module 10, a mounting shaft 20, and a paper guide assembly 30 attached to the mounting shaft 20, and a paper delivery wheel 40.

The driving module 10 comprises a driving motor 11, a driving cap 13, a plurality of first caps 14, and a plurality of second caps 15. A band 16 is attached to and surrounds the driving cap 13, the plurality of first caps 14, and the plurality of second caps 15. A pivot rod 131 is connected to and located between the driving motor 11 and the driving cap 13. The pivot rod 131 is substantially perpendicular to the mounting shaft 20. Each of the plurality of first caps 14 is connected to a first wheel 60 via a first connecting rod 50. Each of the plurality of second caps 15 is connected to a second wheel 80 via a second connecting rod 70. Each of the first wheel 60 and the second wheel 80 includes a circular-arc shaped portion and a protruding portion located at an opposite side relative to the circular-arc shaped portion. The first wheel 60 and the second wheel 80 are parallel to the plurality of first caps 14 and the plurality of second caps 15. The driving cap 13, the plurality of first caps 14, and the plurality of second caps 15 lie on the same row that is substantially parallel to the mounting shaft 20.

The paper guide assembly 30 includes a first guide module and a second guide module. The first guide module includes a plurality of first guide units 31, e.g., three first guide units. The second guide module includes a plurality of second guide units 33, e.g., three second guide units. A spring 311 is attached to each of the plurality of first guide units 31. A second spring 331 is attached to each of the plurality of second guide units 33. In one embodiment, a first end of the spring 311 is fixed to each of the plurality of first guide units 31. A second end of the spring 311 resists against a first metal tab 313. A first end of the second spring 331 is fixed to each of the plurality of second guide units 33. A second end of the second spring 331 resists against a second metal tab 333. The first metal tab 313 extends perpendicularly from a first metal plate 310, fixed in the paper delivery device. The second metal tab 333 extends perpendicularly from a second metal plate 330, fixed in the paper delivery device. Each of the plurality of first guide units 31 has the same structure as each of the plurality of second guide units 33. Each of the plurality of first guide units 31 and the plurality of second guide units 33 includes a paper guide wheel 90 abutting on the paper delivery wheel 40. A notch 100 is defined in each of the plurality of first guide units 31 and the plurality of second guide units 33. A torque spring 200 is mounted in the notch 100 and abuts opposite sides of the notch 100. The torque spring 200 brings pressure to each of the plurality of first guide units 31 and the plurality of second guide units 33. Thus, the paper guide wheel 90 abuts on the paper delivery wheel 40 closely.

FIGS. 1 and 2 show that when the paper guide assembly 30 is in an original state, the protruding portion of the first wheel 60 abuts each of the plurality of first guide units 31. The protruding portion of the second wheel 80 abuts each of the plurality of second guide units 33. A distance between the first guide module and the second guide module has a minimum value. The spring 311 may have a first deformation degree.

Figure 3:
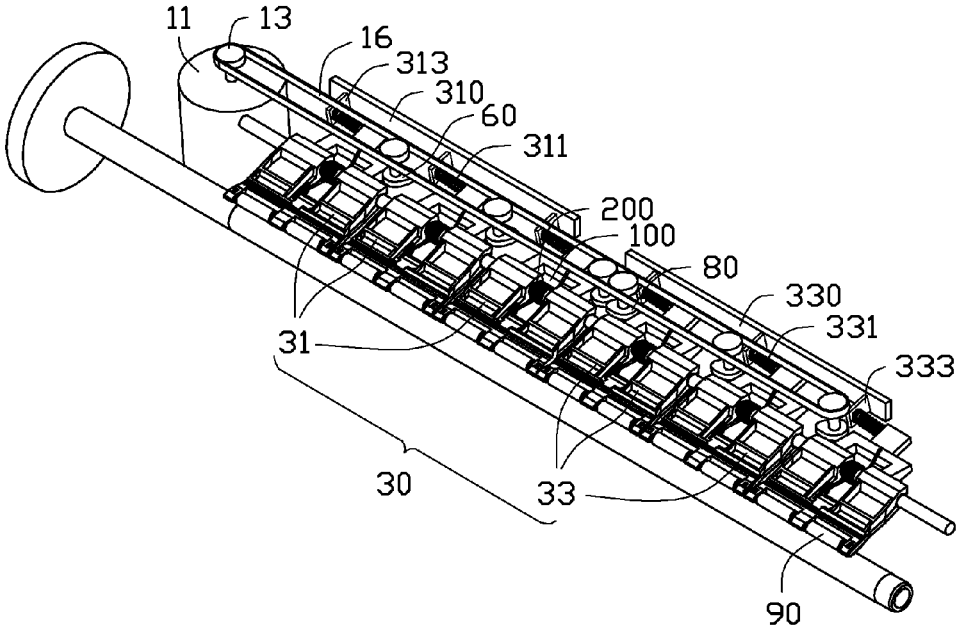
FIG. 3 is similar to FIG. 1, but showing the paper guide assembly in a second position.
Figure 4:
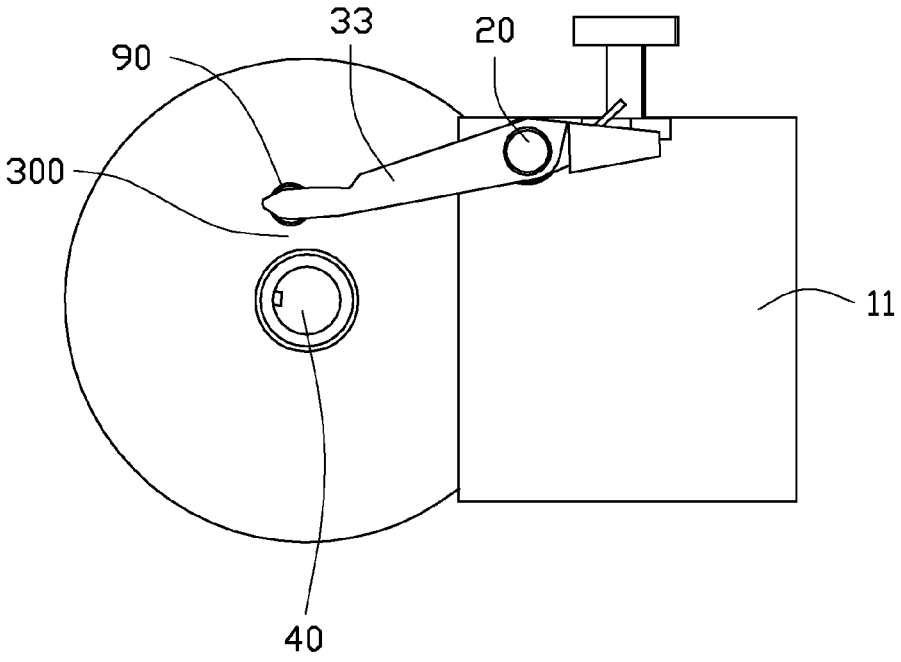
FIG. 4 is a side view of FIG. 1.
Figure 5:
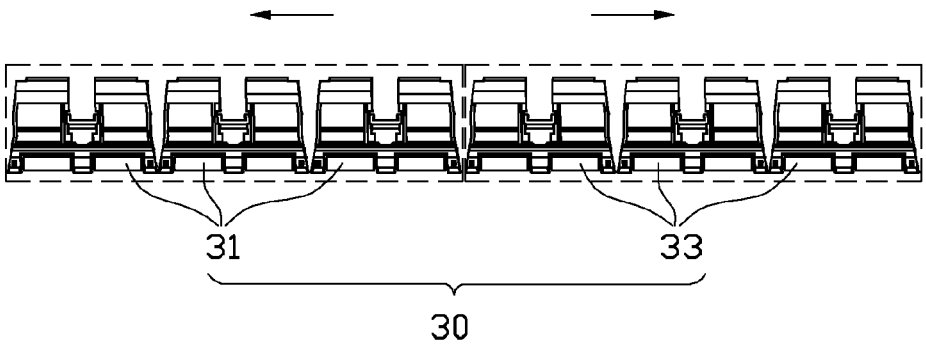
FIG. 5 is another view of the paper guide assembly of FIG. 1.

FIGS. 3 to 5 show that to enlarge the distance between the first guide module and the second guide module, the driving motor 11 drives the mounting shaft 20 to rotate. The paper guide assembly 30 is rotated away from the paper delivery wheel 40. After that, the driving motor 11 drives the driving cap 13 to rotate in a counterclockwise direction. The band 16 moves and drives the plurality of first caps 14 and the plurality of second caps 15 to rotate together with the driving cap 13. The first wheel 60 and the second wheel 80 rotate in the counterclockwise direction until the circular-arc shaped portion of the first wheel 60 is guided against each of the plurality of first guide units 31 and the circular-arc shaped portion of the second wheel 80 is guided against each of the plurality of second guide units 33. The first guide module and the second guide module moves away from each other along the mounting shaft 20. The distance between the first guide module and the second guide module is enlarged and has a maximum value. The spring 311 has a second deformation degree that is greater than the first deformation degree. The plurality of first guide units 31 and the plurality of second guide units 33 rotate back to abut the paper delivery wheel 40. When the distance between the first guide module and the second guide module is enlarged, the paper delivery device is suitable to deliver and print information on a paper with a first size.

FIGS. 1, 2, and 5 show that to lessen the distance between the first guide module and the second guide module, the paper guide assembly 30 is rotated away from the paper delivery wheel 40 again. After that, the driving motor 11 drives the driving cap 13 to rotate in a clockwise direction. The band 16 moves and drives the plurality of first caps 14 and the plurality of second caps 15 to rotate together with the driving cap 13. The first wheel 60 and the second wheel 80 rotate in the clockwise direction until the protruding portion of the first wheel 60 abuts against each of the plurality of first guide units 31 and the protruding portion of the second wheel 80 are guided against each of the plurality of second guide units 33. The first guide module and the second guide module moves towards each other along the mounting shaft 20. The distance between the first guide module and the second guide module is lessened until reaching the minimum value. The plurality of first guide units 31 and the plurality of second guide units 33 rotates back to abut the paper delivery wheel 40. The paper guide assembly 30 returns to the original state. When the distance between the first guide module and the second guide module is diminished, the paper deliver device is suitable to deliver a paper with a second size that is less than the first size.

The plurality of first guide units 31 and the plurality of second guide units 33 are rotated away from the paper delivery wheel 40, before moving the plurality of first guide units 31 and the plurality of second guide units 33 along the mounting shaft 20. Thus, preventing the first resisting module and the second resisting module from rubbing against the paper delivery wheel 40.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A paper delivery device comprising:

a mounting shaft;

a paper guide assembly comprising at least one first guide unit attached to the mounting shaft and at least one second guide unit attached to the mounting shaft;

a first wheel abutting the at least one first guide unit;

a second wheel abutting the at least one second guide unit; and a driving module configured to drive the first wheel and the second wheel to rotate in a first direction or a second direction that is opposite to the first direction, the driving module comprising a driving motor, a driving cap connected to the driving motor, at least one first cap connected to the first wheel, and at least one second cap connected to the second wheel; and a band surrounding the driving cap, the at least one first cap, and the at least one second cap;

wherein the at least one first guide unit and the at least one second guide unit is are movable towards each other when the first wheel and the second wheel are rotated in the first direction, or movable away from each other when the first wheel and the second wheel are rotated in the second direction.

2. The paper delivery device of claim 1, wherein each of the first wheel and the second wheel comprises a circular-arc shaped portion and a protruding portion located at an opposite side relative to the circular-arc shaped portion; when the circular-arc shaped portion abuts each of the at least one first guide unit and the at least one second guide unit, a distance between the at least one first guide unit and the at least one second guide unit has a maximum value; and when the protruded portion abuts each of the at least one first guide unit and the at least one second guide unit, the distance between the at least one first guide unit and the at least one second guide unit has a predetermined minimum value.

3. The paper delivery device of claim 1, wherein the at least one first cap and the at least one second cap are parallel to the first wheel and the second wheel.

4. The paper delivery device of claim 1, further comprising a paper delivery wheel, each of the at least one first guide unit and the at least one second guide unit comprises a paper guide wheel, each of the at least one first guide unit and the at least one second guide unit is rotatable between a first position, where the paper guide wheel abuts on the paper delivery wheel, and a second position, where the paper guide wheel is spaced away from the paper delivery wheel.

5. The paper delivery device of claim 4, wherein the mounting shaft is substantially parallel to the paper delivery wheel, and an axis of the driving motor is substantially parallel to the mounting shaft.

6. The paper delivery device of claim 5, wherein the at least one first cap is connected to the first wheel via a first connecting rod, the at least one second cap is connected to the second wheel via a second connecting rod, and each of the first connecting rod and the second connecting rod is substantially perpendicular to the mounting shaft.

7. The paper delivery device of claim 6, wherein a notch is defined in each of the at least one first guide unit and the at lest one second guide unit, and a torque spring is mounted in the notch to urge each of the at least one first guide unit and the at least one second guide unit abutting on the paper delivery wheel.

8. The paper delivery device of claim 1, wherein the first direction is a clockwise direction, and the second direction is a counterclockwise direction.

9. A paper delivery device comprising:

a mounting shaft;

a paper guide assembly comprising a first guide module and a second guide module attached to the mounting shaft and rotatable together with the mounting shaft; the first guide module comprising a plurality of first guide units, and the second guide module comprising a plurality of second guide units;

a first wheel abutting each of the plurality of first guide units;

a second wheel abutting each of the plurality of second guide units; and a driving module configured to drive the first wheel and the second wheel to rotate in a first direction or a second direction that is reverse to the first direction;

wherein the first guide module and the second guide module are movable towards each other when the first wheel and the second wheel are rotated in the first direction, or movable away from each other when the first wheel and the second wheel are rotated in the second direction.

10. The paper delivery device of claim 9, wherein each of the first wheel and the second wheel comprises a circular-arc shaped portion and a protruding portion located at an opposite side relative to the circular-arc shaped portion; when the circular-arc shaped portion abuts each of the first guide module and the second guide module, a distance between the first guide module and the second guide module has a maximum value; and when the protruded portion abuts each of the first guide module and the second guide module, the distance between each of the first guide module and the second guide module has a predetermined minimum value.

11. The paper delivery device of claim 9, wherein the driving module comprises a driving motor, a driving cap connected to the driving motor, at least one first cap connected to the first wheel, and at least one second cap connected to the second wheel; and a band surrounding the driving cap, the at least one first cap, and the at least one second cap.

12. The paper delivery device of claim 11, wherein the at least one first cap and the at least one second cap are parallel to the first wheel and the second wheel.

13. The paper delivery device of claim 11, further comprising a paper delivery wheel, each of the plurality of first guide units and the plurality of second guide units comprises a paper guide wheel, each of first guide module and the second guide module is rotatable between a first position, where the paper guide wheel abuts on the paper delivery wheel, and a second position, where the paper guide wheel is spaced away from the paper delivery wheel.

14. The paper delivery device of claim 13, wherein the mounting shaft is substantially parallel to the paper delivery wheel, and an axis of the driving motor is substantially parallel to the mounting shaft.

15. The paper delivery device of claim 14, wherein the at least one first cap is connected to the first wheel via a first connecting rod, the at least one second cap is connected to the second wheel via a second connecting rod, and each of the first connecting rod and the second connecting rod is substantially perpendicular to the mounting shaft.

16. The paper delivery device of claim 15, wherein a notch is defined in each of the plurality of first guide units and the plurality of second guide units, and a torque spring is mounted in the notch to urge each of the plurality of first guide units and the plurality of second guide units abutting on the paper delivery wheel.

17. The paper delivery device of claim 9, further comprising a first elastic member attached to each of the plurality of first guide units and a second elastic member attached to each of the plurality of second guide units; wherein the first elastic member and the second elastic member are capable of urging the first guide module and the second guide module moving towards each other after being released.

* * * * *